US010912355B2

(12) United States Patent
Huynh

(10) Patent No.: US 10,912,355 B2
(45) Date of Patent: Feb. 9, 2021

(54) JEWELRY THAT REVERSIBLY TRANSITIONS BETWEEN TWO DIFFERENT CONFIGURATIONS

(71) Applicant: Chi Huynh, San Dimas, CA (US)

(72) Inventor: Chi Huynh, San Dimas, CA (US)

( * ) Notice: Subject to any disclaimer, the term of this patent is extended or adjusted under 35 U.S.C. 154(b) by 0 days.

(21) Appl. No.: 16/471,495

(22) PCT Filed: Sep. 14, 2018

(86) PCT No.: PCT/US2018/051236
§ 371 (c)(1),
(2) Date: Jun. 19, 2019

(87) PCT Pub. No.: WO2019/070386
PCT Pub. Date: Apr. 11, 2019

(65) Prior Publication Data

US 2020/0113296 A1 Apr. 16, 2020

Related U.S. Application Data

(60) Provisional application No. 62/559,403, filed on Sep. 15, 2017.

(51) Int. Cl.

| | |
|---|---|
| ***A44C 15/00*** | (2006.01) |
| ***A44C 17/02*** | (2006.01) |
| ***A44C 25/00*** | (2006.01) |
| ***A44C 9/00*** | (2006.01) |

(52) U.S. Cl.
CPC ..... *A44C 15/0025* (2013.01); *A44C 9/00* (2013.01)

(58) Field of Classification Search
CPC ..... A44C 15/0025; A44C 9/00; A44C 25/00; A44C 27/008
See application file for complete search history.

(56) References Cited

U.S. PATENT DOCUMENTS

| | | | | | |
|---|---|---|---|---|---|
| 419,251 | A | * | 1/1890 | Goff | A44C 17/02 63/28 |
| 2,561,217 | A | * | 7/1951 | Muir | A41G 1/005 428/26 |
| 3,365,877 | A | * | 1/1968 | Altman | A44C 17/0275 368/285 |
| 3,471,964 | A | * | 10/1969 | Cherry | A63H 33/00 446/268 |
| 3,733,851 | A | | 5/1973 | D'Apuzzo | |
| 3,805,549 | A | | 4/1974 | Nielsen | |
| 4,912,944 | A | | 4/1990 | Crosley | |

(Continued)

OTHER PUBLICATIONS

PCT/US2018/051236 ISR and WO dated Mar. 26, 2019.

*Primary Examiner* — Jack W Lavinder
(74) *Attorney, Agent, or Firm* — Wagenknecht IP Law Group, PC

(57) ABSTRACT

Article of jewelry that reversibly transitions between two different ornamentations by way of a plurality of solid strands, each strand formed from a two-way shape memory alloy trained to reversibly transition between two set positions in response to two different temperatures, where the strands are anchored from shape memory movement at a proximal end and connected to distal elements at a distal end, thereby directing shape memory movement of the distal elements in response to the two different temperatures.

16 Claims, 10 Drawing Sheets

(56) References Cited

U.S. PATENT DOCUMENTS

| | | | | |
|---|---|---|---|---|
| 5,090,569 | A * | 2/1992 | Nissen | A63H 37/00 206/457 |
| 5,518,433 | A | 5/1996 | Sneddon | |
| 6,406,177 | B1 | 6/2002 | Fukushima et al. | |
| 7,351,467 | B2 * | 4/2008 | Blonder | A47G 19/2227 428/132 |
| 8,991,210 | B1 | 3/2015 | Stewart, Jr. | |
| 2003/0019242 | A1 | 1/2003 | White | |
| 2004/0025984 | A1 | 2/2004 | Holemans et al. | |
| 2005/0006566 | A1 | 1/2005 | Maeda | |
| 2006/0032270 | A1 * | 2/2006 | Doyno | A44C 17/0233 63/29.1 |
| 2014/0147614 | A1 * | 5/2014 | Taylor | A44C 17/0266 428/67 |

* cited by examiner

1C 1C, 500

JEWELRY THAT REVERSIBLY TRANSITIONS BETWEEN TWO DIFFERENT CONFIGURATIONS

CROSS REFERENCE TO RELATED APPLICATIONS

This application is a US national phase application under 35 USC § 371 of international patent application no. PCT/US2018/051236, filed Sep. 14, 2018, which itself claims benefit of priority to U.S. provisional patent application No. 62/559,403, filed Sep. 15, 2017. Each application referenced in this paragraph is herein incorporated by reference in its entirety.

TECHNICAL FIELD

The invention relates to jewelry and more specifically to articles of jewelry that transition between two distinct ornamentations by way of shape memory alloys.

BACKGROUND OF THE INVENTION

Jewelry is worn by nearly all cultures. It is commonly given at holidays, weddings, anniversaries and other events. One feature of jewelry that makes it different and much more special than anything else in the fashion industry is that jewelry doesn't discriminate. It doesn't matter what size, shape or skin color someone is. In addition, jewelry can be one thing that makes you feel unique.

Thus, with the continued desire for jewelry and unique pieces, there is a continuing need for new innovative jewelry designs. However, jewelry can be expensive. This is in part due the time it takes to create intricate designs and the value of gems and metals that are commonly incorporated into jewelry.

The above can be addressed by providing different designs within a single article of jewelry. For example, U.S. Pat. No. 4,912,944 provides an approach where an ornamental substrate is held by magnetic attraction. In particular, the ornamental substrate is provided with a magnet, thereby allowing different ornamental substrates to be applied to a same metal base. However, these approaches require the use of magnets. As the magnet size decreases so does the magnetic attraction. As such, the approach would not be preferred when setting small, high value gems. They can easily be lost. In addition, the user must manually change from one ornamentation to another by adding and subtracting pieces.

Thus, there is a need to develop articles of jewelry that can display multiple ornamentations while minimizing the risk of losing interchangeable components.

BRIEF SUMMARY OF THE INVENTION

The invention addresses the above needs and provides related benefits. In particular the invention provides an article of jewelry that reversibly transitions between two different pre-set configurations in response to exposure to two different temperatures, thereby eliminating the need to manually add and replace ornamental features. The invention also provides an article of jewelry that reversibly transitions between two different pre-set configurations in response to exposure to two different temperatures too effectively lock and unlock ornamental elements, thereby reducing the risk of loss of interchangeable ornamental elements The above is accomplished in one aspect of the invention by way of an article of jewelry that reversibly transitions between two different ornamentations without mechanical intervention. The article of jewelry includes a plurality of solid strands, each strand formed from a two-way shape memory alloy trained to reversibly transition between two set positions in response to two different temperatures. The strands are anchored from shape memory movement at a proximal end and connected to distal elements at a distal end, and therefore direct shape memory movement of the distal elements in response to exposure to the two different temperatures. In preferred embodiments, the shape memory alloy is a nickel titanium alloy, and in particular nitinol.

The two positions are preferably set by training the memory shape alloy to transition to a first position then training the memory shape alloy to transition to a second position. Since the invention provides a plurality of strands, the strands can be trained together or separately. Therefore, in some embodiments one of the two set positions differs between two different strands, and in some embodiments both of the two set positions differ between two different strands. In furtherance of each, the plurality of strands can be arranged in layers so that strands having a set position comprising a larger arc measure are positioned outside of strands comprising a set position comprising a smaller arc measure. As such, in some embodiments at least some of the plurality of strands transition between arcs of different measure.

In some embodiments the plurality of strands comprise a tighter coil in one set position compared to another set position. In other embodiments at least some of the plurality of strands transition between linear and non-linear set positions upon exposure to the different temperatures.

At the distal end of the strand is preferably provided a distal element, such as a precious or semi-precious gem or metal. In some embodiments, in response to the two different temperatures, a first set of distal elements close against one another in a first set position and open away from one another in a second set position. In further embodiments, a first set of distal elements close against one another in a first set position to hide an inner ornamentation and open away from one another in a second set position to display the inner ornamentation. In a preferred variation, a first set of distal elements are leaflets that close against one another in a first set position and open away from another in a second set position. Accordingly, the leaflets can be configured to close against one another to hide an inner ornamentation in a first set position and open away from one another to reveal the inner ornamentation in a second set position. In addition, a second set of distal elements can include precious or semi-precious gems maintained outside of the leaflets. In still further embodiments, the inner ornamentation itself also incorporates shape memory alloy strands trained with one way shape memory or two way shape memory.

The distal elements connect to the distal ends of the shape memory alloy strands and thus move in response to the different temperatures. In some embodiments the distal elements are precious or semi-precious gems. Non-limiting examples of suitable gems include an agate, an alexandrite, an amber, an ametrine, an amethyst, an aquamarine, an apatite, a beryl, a bloodstone, a chrysoheryl or cat-eye, a citrine, a corundum, a chalcedony, a chysocolla, a coral, a diamond, an emerald, a green beryl, a garnet, a quartz, a lolite, a jadcite, a kupzite, a lapis lazuli, a moonstone, a malachite, a moamite, an onyx, an opal, a pearl, a peridot, a red corundum, a ruby, a sardonyx, a sapphire, a spessartime, a sphene, a spinel, a star ruby and sapphire, a sunstone, a tanzanite, a tiger eye, a tourmaline, a topaz, a turquoise, a tsavorite, and a zircon. In other embodiments, the distal elements are formed form a precious or semi-precious metal. Common metals include gold, silver, platinum and others.

In a related aspect, article of jewelry is provided which includes precious or semi-precious gems or metals that interchangeably connect to a fenestrated base, each gem held by a bezel. The improvement is that the bezel has a shape memory alloy trained to reversibly transition between two set positions in response to two different temperatures, where a first set position locks the bezel through the fenestrations of the base and a second set position releases the bezel from the fenestrations of the base. As such, adjusting the temperature permits the bezel and thus gem to lock and unlock or release from the base, which provides the interchangeability of gems.

BRIEF DESCRIPTION OF THE DRAWINGS

Embodiments of the invention can be better understood with reference to the following drawings, which are part of the specification and represent preferred embodiments. The components in the drawings are not necessarily to scale, emphasis instead being placed upon illustrating the principles of the invention. And, in the drawings, like reference numerals designate corresponding parts throughout the several views

DETAILED DESCRIPTION OF PREFERRED EMBODIMENTS

Jewelry is provided that reversibly and reproducibly transitions between two pre-set configurations when exposed to two different temperatures. This is accomplished in part by training a plurality of strands formed from a shape memory alloy to transition between two different positions depending on the applied temperature and anchoring one end of the plurality of strands, thereby directing the memory shape movement at the opposing end of the strands. The term "memory shape movement" as used herein refers to movement of the memory shape alloy towards a set position in response to a change in temperature. By training a plurality strands to transition between individually tailored pre-set positions, the jewelry displays two complex ornamentations without mechanical intervention.

The technical approach can be applied to a variety of jewelry items including rings, earrings, pendants, necklaces, bracelets and many others. Similarly, the distal elements displayed and/or moving ornamentation can include precious or semi-precious metals. Non-limiting examples include gold, silver, platinum and others used in the jewelry industry. The distal elements displayed and/or ornamentation can be precious or semi-precious gems. Nonlimiting examples include an agate, an alexandrite, an amber, an ametrine, an amethyst, an aquamarine, an apatile, a beryl, a bloodstone, a chrysoberyl or cat-eye, a citrine, a corundum, a chalcedony, a chysocolla, a coral, a diamond, an emerald, a green beryl, a garnet, a quartz, a lolite, a jadcite, a kupzite, a lapis lazuli, a moonstone, a malachite, a moamite, an onyx, an opal, a pearl, a peridot, a red corundum, a ruby, a sardonyx, a sapphire, a spessartime, a sphene, a spinel, a star ruby and sapphire, a sunstone, a tanzanite, a tiger eye, a toumialine, a topaz, a turquoise, a tsavorite, and a zircon.

For clarity of disclosure, and not by way of limitation, the invention is discussed according to different detailed embodiments; however, the skilled artisan would recognize that features of one embodiment can be combined with other embodiments and is therefore within the intended scope of the invention.

Figure 1:
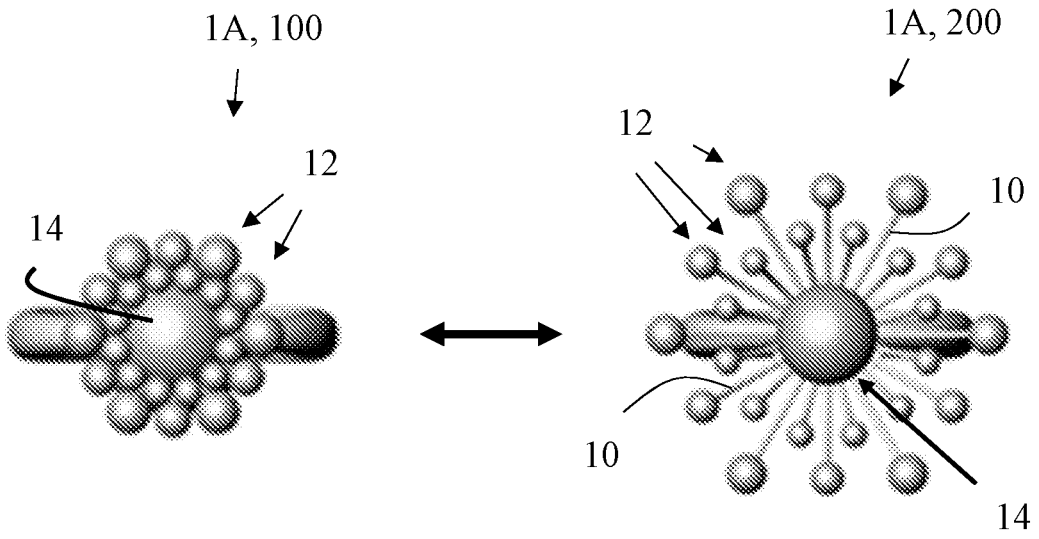
FIG. 1 depicts a ring 1A that reversibly transitions between a closed ornamentation 100 and an open ornamentation 200 in response to changes in temperature.
Figure 2:
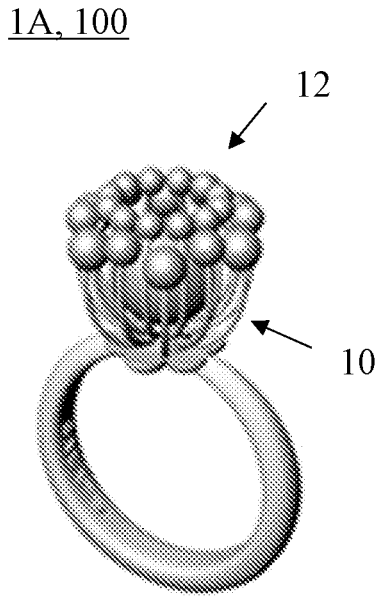
FIG. 2 is an isometric view of the ring 1A of FIG. 1 in a closed orientation 100.

Turning now to exemplary embodiments, beginning at FIG. 1, a ring 1A is depicted, which reversibly transitions between open 100 and closed 200 ornamentations in response to a sufficient change in temperature. In particular, as shown in FIG. 1 and FIG. 2, at a first temperature, the ring 1A is presented in a closed ornamentation 100. Here the closed ornamentation 100 is characterized by a plurality of distal elements 12, in this case pearls, positioned in close proximity to the primary gem 14, in this case also a pearl. However, when exposed to a second temperature that is sufficiently higher or lower than the first temperature, the ring 1A transitions to the open ornamentation 200 as shown in FIG. 1. Here the open ornamentation 200 is characterized by the plurality of distal elements 12 extending away from the primary gem 14. Transitioning between open 100 and closed 200 ornamentation is reversible, meaning that the ring 1A will repeatedly open 100 and close 200 when repeatedly exposing the ring 1A to sufficiently high and sufficiently low temperatures.

The mechanism for transitioning the jewelry 1, 1A between the two ornamentations is performed by way of providing a plurality of shape memory strands 10 trained to move between two pre-set positions in response to a sufficient change in temperature, anchoring one end of each strand and providing a free end that is not anchored. Shape memory movement of the strands 10 causes the transition. As such, connecting the free end of the strand 10 to a distal element 12, such as a precious or semi-precious gem or metal, causes the distal element 12 to move according to a temperature dependent programming.

Figure 3:
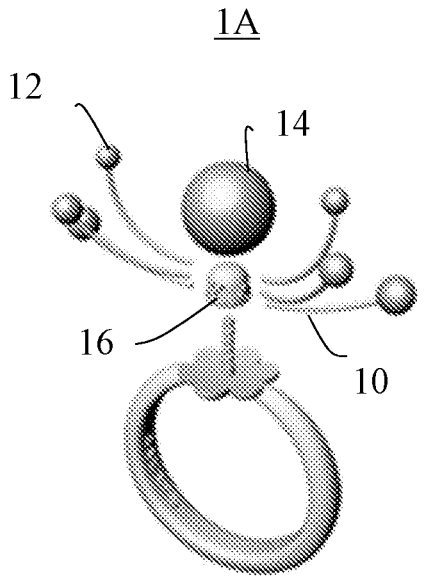
FIG. 3 is a partially exploded view of a ring 1A.

To this end, as shown in FIGS. 1-3, a primary hub 16 connects to a plurality of distal elements 12 via a plurality of strands 10 formed from a shape memory alloy that is trained to perform the transitions. For consistency, the term "proximal" as used herein refers to the end of the strand 10 that is nearest the anchor point (e.g. hub 16) of the strand 10, and the term "distal" as used herein refers to the end of the strand 10 that opposite the anchor point of the strand 10. Thus, the plurality of strands 10 are each anchored at the proximal end and connected to a distal element 12, typically an ornamental element such as a precious or semi-precious gem or metal, at the distal end.

Transitioning between two distinct ornamentations is by way of using a shape memory alloy. Shape memory alloys are metallic alloys which can recover permanent strains when they are heated above a certain temperature. The key characteristic of all shape memory alloys is the occurrence of a martensitic phase transformation. The martensitic transformation is a shear-dominant diffusionless solid-state phase transformation occurring by nucleation and growth of the martensitic phase from a parent austenitic phase. When a shape memory alloy undergoes a martensitic phase transformation, it transforms from its high-symmetry, usually cubic, austenitic phase to a low-symmetry martensitic phase.

In preferred embodiments, the shape memory alloy of the invention is nitinol. As used herein "nitinol" is intended to encompass all shape memory alloys referred to as nitinol in the medical and mechanical arts. Among these, Nitinol 55 is a metal alloy of about 55 weight % nickel and 45 weight % titanium. Nitinol 60 is another encompassed alloy. Nitinol possess a shape memory, in that it has the ability to be deformed at one temperature then return to its original undeformed shape at another. That is, the transformation is "reversible", meaning that heating above the transformation temperature will revert the crystal structure to the simpler austenite phase. Nitinol is particular useful in the invention because transformation in both directions is instantaneous.

The memory effect of nitinol can be one way or two way. In one way training, the alloy can be bent or stretched and will hold the shape until heating above the transition temperature. With the one-way effect, cooling from high temperatures does not itself cause a macroscopic shape change.

Preferably, the articles of jewelry 1 (e.g. 1A-C) herein use a two-way memory e feet. Two-way shape-memory effect is the effect that the material remembers two different shapes: one at a low temperature, and one at a high-temperature. A material that shows a shape-memory effect during both heating and cooling is said to have two-way shape memory. The reason the material behaves so differently in these situations lies in training. During training the shape memory alloy can "learn" to behave in a certain way. Under normal circumstances, a shape-memory alloy "remembers" its low-temperature shape, but upon heating to recover the high-temperature shape, immediately "forgets" the low-temperature shape. However, it can be "trained" to "remember" to leave some reminders of the deformed low-temperature condition in the high-temperature phases. There are several ways of doing this and are available within the mechanical arts. As such, the invention is not limited to any particular method, although improvements to training are provided herein.

Training or shape setting a shape memory alloy, such as nitinol, to one of the two set positions can be performed by holding the alloy in a first desired position and heating the alloy to about 500° C. (932° F.). For instance, to form the open position 100 depicted in FIG. 1, broadly, a nitinol wire was tightly wrapped many times around a mandrel of a first diameter (about 15, 20 or 25 mm) and heated in a kiln to 970° F. for 5 minutes, then was allowed to cool. The tight wrapping was found to significantly improve training. Though non-limiting, afterwards it was found that the shape memory strand would transition to this phase upon reaching about 115° F. Achieving this temperature can be by applying heat prior wearing the jewelry if desired.

Training or shape setting nitinol to another of the two set positions can be performed by holding the alloy in a second desired position and substantially chilling the alloy. For instance, to form the closed position 200 depicted in FIG. 1 and FIG. 3, broadly, the same nitinol wire previously trained under heat was tightly wrapped many times around a small diameter mandrel (e.g. about 8 mm) of a second desired arc or circumference then repeatedly cycled between a cold state and room temperature state. Experimentally, it was found that by using dry ice in the cold state, the number of cycles could be reduced compared to ice water from about 50 cycles to about 5 cycles. Afterwards, it was found that the shape memory strand 10 would transition to this phase upon dropping its temperature to about 60° F. This temperature will vary depending on the formulation of the shape memory strand. Nonetheless, after setting the two positions, the shape memory alloy strand 10 will transition to the set positions when exposed to either a high (e.g. 115° F.) or low (e.g. about 60° F.) temperature.

After setting the two positions, the shape memory strand 10 is cut to a desired length (in FIGS. 1-3 and FIG. 5, the strand was cut to 13 mm). As shown more clearly in FIG. 3, in preferred embodiments the plurality of strands 10 are each anchored to a primary hub 16, which itself can be mounted for display. Anchoring the strands 10 to the hub 16 can be by way of forming through bores in the hub 16, inserting the proximal end of the strands 10 through the through bores, then soldering or gluing the proximal ends to the hub 16. The hub 16 can then be glued or soldered to a desired jewelry component, such as a ring FIG. 1:1A, an earring FIG. 14:1C, a pendent FIG. 10:1B, or any other suitable jewelry component. Likewise, the plurality of strands 10 can each be connected to distal elements 12 by drilling into the distal element 12 and gluing the strand inside the distal element 12 (shown more clearly in FIG. 5).

Figure 4:
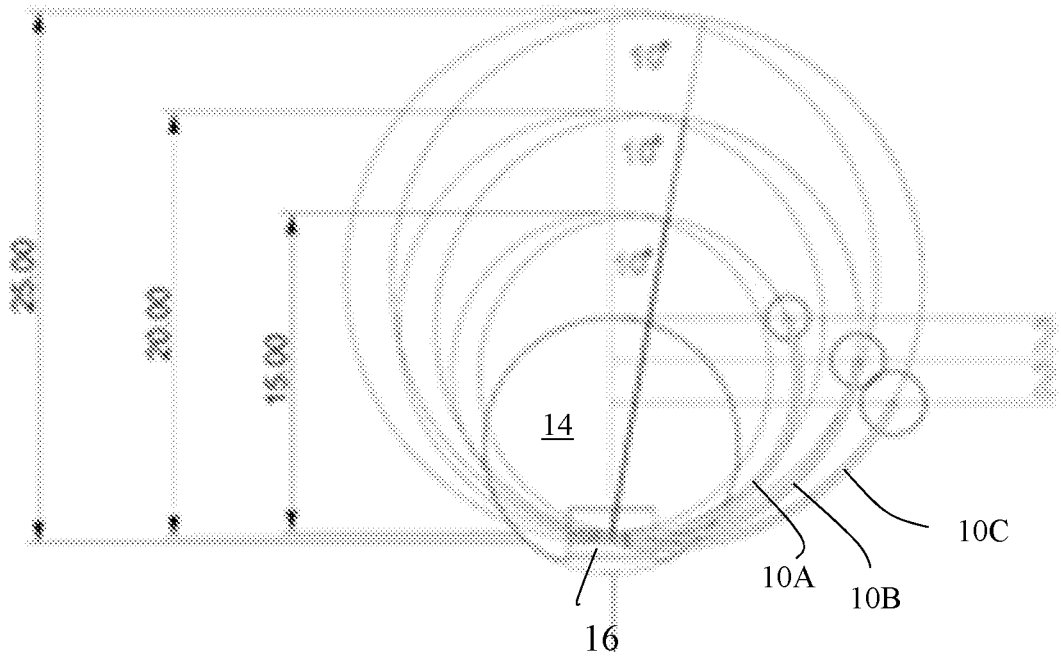
FIG. 4 is a schematic showing three different strands 10A, 10B, 10C with open set positions differing from one another.
Figure 5:
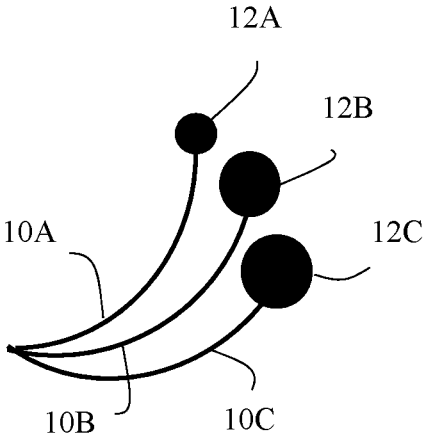
FIG. 5 is a schematic showing three different strands 10A, 10B, 10C with open set positions differing from one another.

As can be seen more clearly in FIGS. 4-5, by training different strands 10A, 10B, 10C to transition to different set positions, complex ornamentation can be developed. FIGS. 4-5 provide a schematic showing three distinct trained positions for each of three equal identical length strands 10A, 10B, 10C to provide the open ornamentation 200 shown in FIG. 1. As shown in FIG. 4, three different open positions are established. An innermost strand 10A is trained to follow a circumference of a circle that has a diameter of about 15 units, the intermediate strand 10B is trained to follow a circumference of a circle that has a diameter of about 20 units, and the outermost strand 10C is trained to follow a circumference of a circle that has a diameter of about 25 units. The formed arcs paths were then offset about 10° counter clockwise from a center of the primary hub 16 for improved aesthetics around a primary gem 14. Further, each strand is positioned so that the distal tips between innermost 10A and intermediate 10B strand as well as between intermediate strand 10B and outermost strand 10C are 2 mm apart. By continuing this approach around the primary hub 16, the open ornamentation 200 substantially as shown in FIG. 1 can be achieved.

Also shown in FIG. 5, the distal elements can also vary in size. In FIG. 5, the innermost distal element 12A is a pearl sized 2 mm, the intermediate distal element 12B is a pearl sized 2.5 mm, and the outermost distal element 12C is a pearl sized 3 mm.

Figure 6:
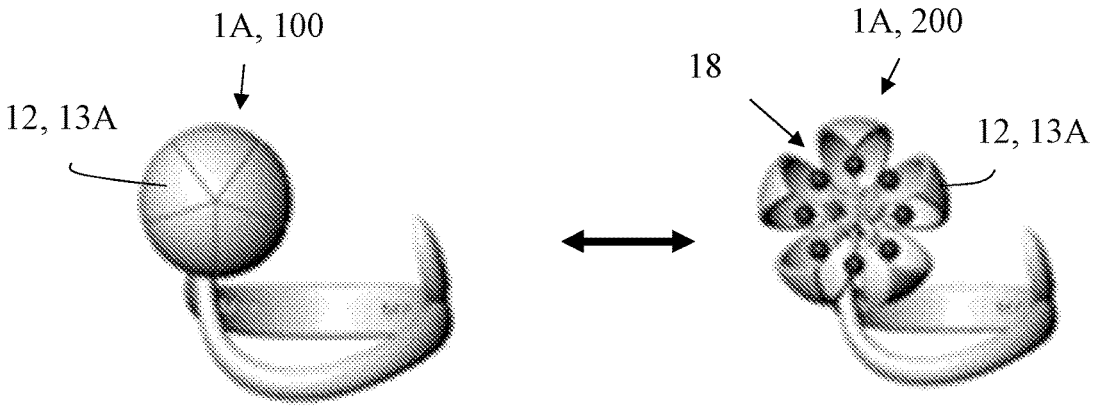
FIG. 6 depicts a ring 1A that reversibly transitions between a closed ornamentation 100 and an open ornamentation 200 in response to changes in temperature.
Figure 7:
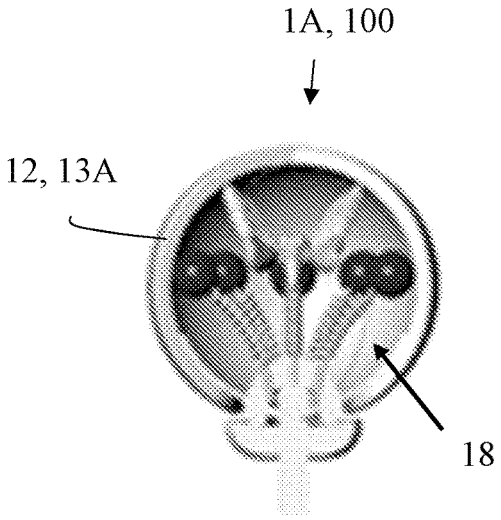
FIG. 7 is a partial cutaway view of a ring 1A substantially as provided in FIG. 6, in a closed ornamentation 100.
Figure 8:
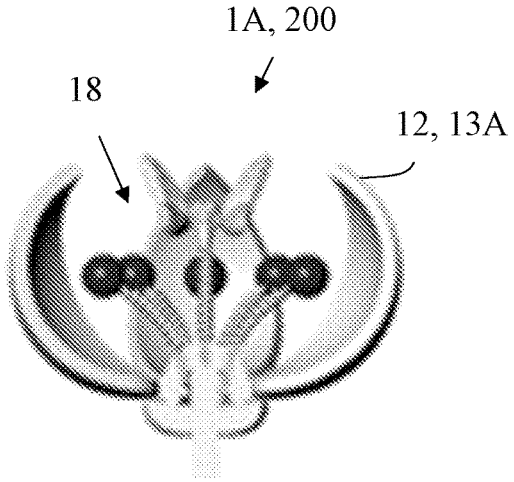
FIG. 8 is a partial cutaway view of a ring 1A substantially as provided in FIG. 6, in an open ornamentation 200.
Figure 9:
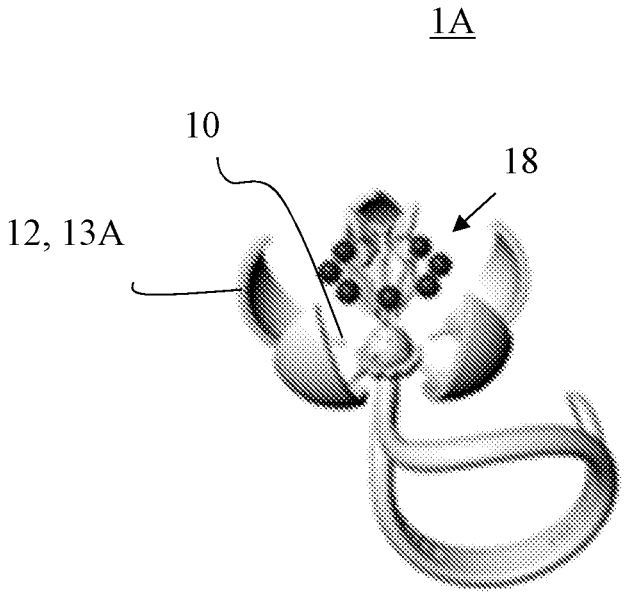
FIG. 9 is a partially exploded view of a ring 1A substantially as provided in FIG. 6.

Turning now to FIGS. 6-9, in a variation of the above, an article of jewelry 1 (e.g. 1A) was formed, having two-way shape memory alloy strands 10 that transition between two set positions, where a first set of distal elements 12 are configured to close against one another in a first set position to hide an inner ornamentation 18 and open away from each other in a second position to expose the inner ornamentation 18. As such, FIG. 6 depicts a ring 1A, having a first set of distal elements 12 embodied as leaflets 13, where the leaflets 13 close 100 against one another in a first state to form a hollow shell, but when exposed to a sufficient change in temperature, such as an increase in temperature, the leaflets 13 open 200 away from one another to expose an interior of the shell. When exposed to sufficient change in temperature, such as a sufficient decrease in temperature, the leaflets 13 again return to their closed position 100 thereby again hiding the internal ornamentation 18. As shown a little more clearly in FIG. 9, the mechanism for transitioning the ring 1A between the two different ornamentation is by anchoring the proximal end of each strand 10 to a primary hub 16 and connecting the distal end of the strand 10 to one of the leaflets 13. By repeating and arranging this orientation around the primary hub 16, the effect depicted in FIG. 6 can be achieved.

Figure 10:
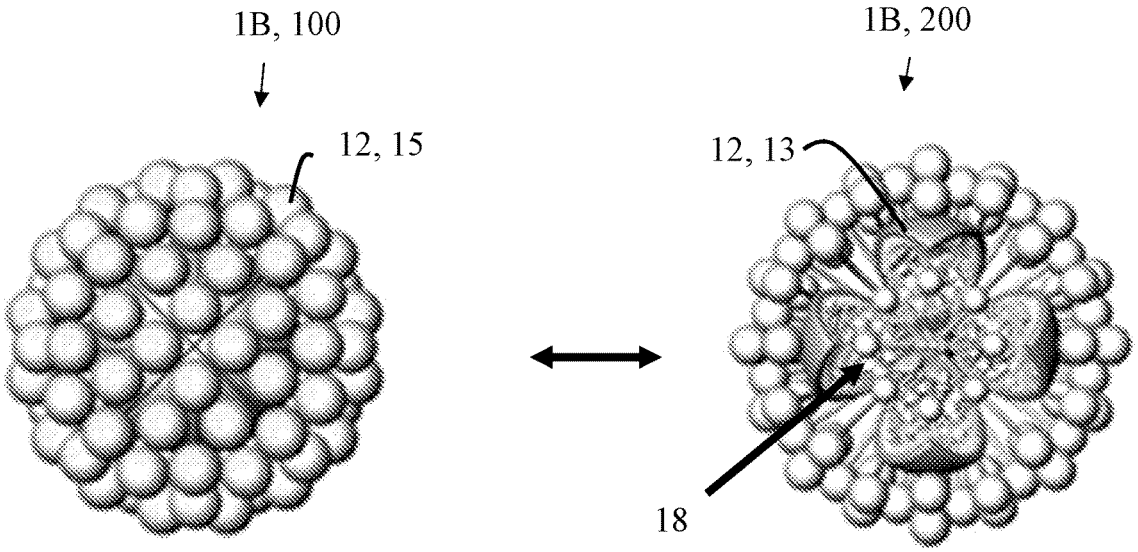
FIG. 10 depicts a portion of a pendant 1B that reversibly transitions between a closed ornamentation 100 and an open ornamentation 200 in response to changes in temperature.
Figure 11:
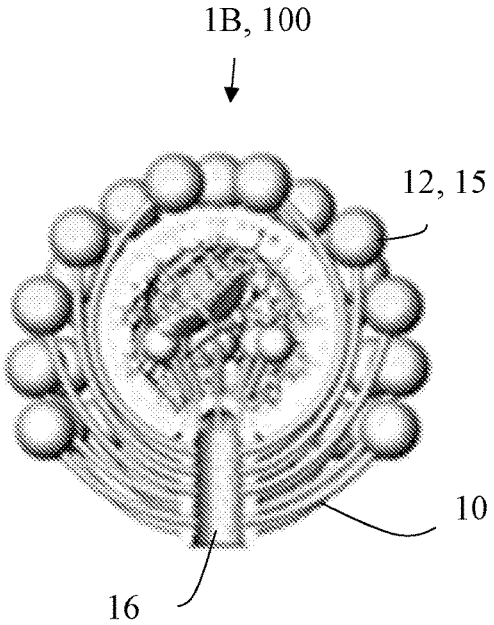
FIG. 11 is a partial cutaway view of a portion of a pendant 1B substantially as provided in FIG. 10, in a closed ornamentation 100.
Figure 12:
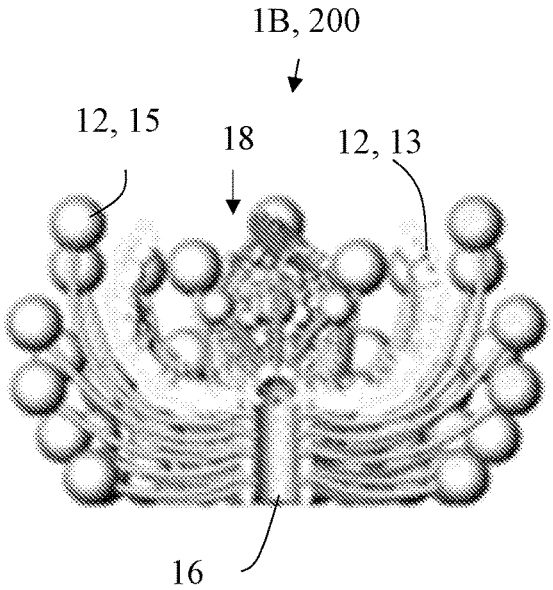
FIG. 12 is a partial cutaway view of a portion of a pendant 1B substantially as provided in FIG. 10, in an open ornamentation 200.
Figure 13:
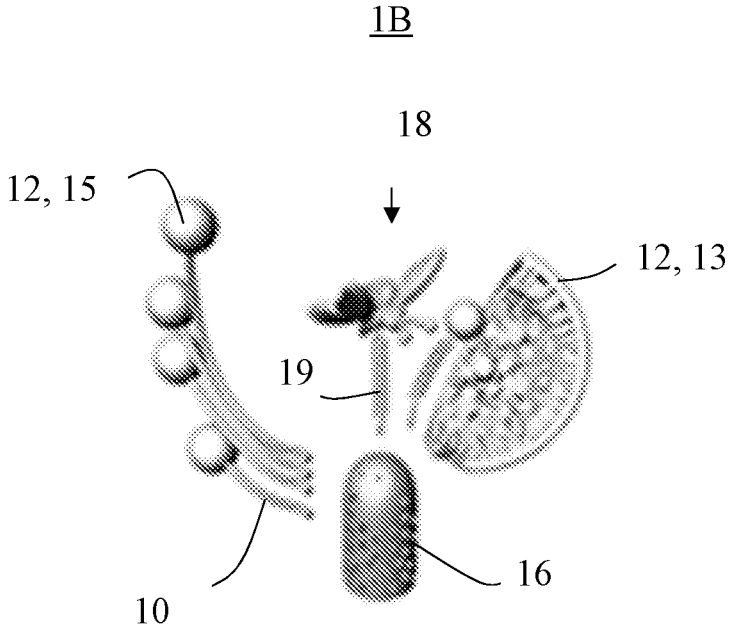
FIG. 13 is a partially exploded view of a portion of a pendant 1B substantially as provided in FIG. 10.

FIGS. 10-13 depict another variation, which provides an article of jewelry 1 (e.g. 1B), having a plurality of strands 10 formed from a two-way shape memory alloy trained to transition between two set positions, where a first ornamentation is characterized by a set of distal elements 12 closed 100 together to hide an internal ornamentation 18 (FIG. 10 and FIG. 11) and open 200 away from one another to expose the inner ornamentation 18 (FIG. 10 and FIG. 12). In addition, another set of distal elements 12, 15 are arranged outside of the first set of distal elements 12. As shown in more detail in the exploded view of FIG. 13, a first set of distal elements 12 embodied as leaflets 13 are connected to a strand formed from a two way trained, shape memory alloy, and a second set of distal elements 12, 15 are connected to strands 10 formed from a two way trained shape memory alloy (having different arc measures). Furthermore, the inner ornamentation 18 itself is formed from a third set of distal elements 12, 17 are connected to a stranded 10 formed from a two way trained shape memory alloy (set position is a spiral).

In FIG. 10 and in the cutaway view of FIG. 11, a closed ornamentation 100 is shown, where the leaflets 13 are connected to shape memory alloy strands 10, which are anchored to the primary hub 16. When closed 100, the leaflets 13 close against one another to form a hollow shell. In addition, the second set of distal elements 12, 15 is also connected to shape memory alloy strands 10, which are also anchored to the primary hub 16. When closed, the second distal elements 12, 15 are positioned against the outside surface of the leaflets 13 or against other second distal elements 12, 15. FIG. 10 and the cutaway view of FIG. 12 show an open ornamentation 200, where the distal end of the strands 10 connected to the leaflets 13 move outward and away from one another in response to a sufficient temperature change to open the leaflets 13 away from one another, thereby exposing an interior of the shell and thus the inner ornamentation 18. Also shown in FIG. 10, and the cutaway view of FIG. 12, the second distal elements 12, 15 are moved outward and away from the leaflets 13 in response to the sufficient change in temperature due to their connection to strands of two way shape memory alloy trained accordingly.

Figure 14:
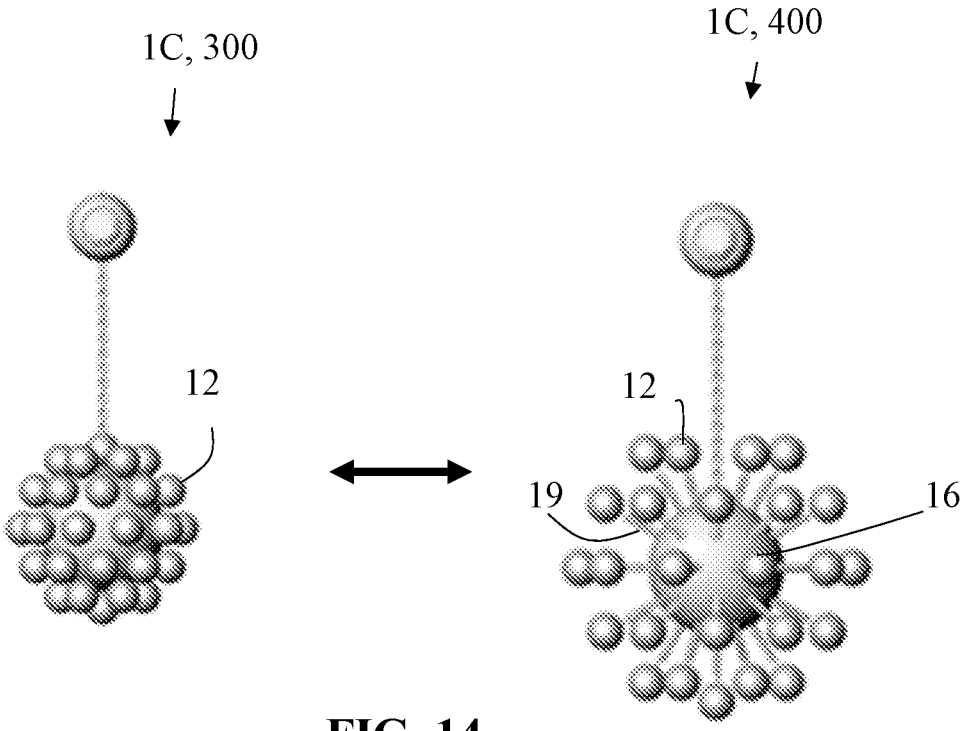
FIG. 14 depicts an earring 1C that reversibly transitions between a contracted ornamentation 300 and an expanded ornamentation 400 in response to changes in temperature.
Figure 15:
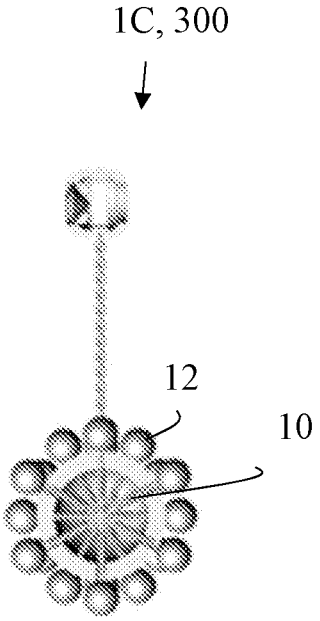
FIG. 15 is a partial cutaway view of an earring 1C substantially as provided in FIG. 14, in a contracted ornamentation 300.
Figure 16:
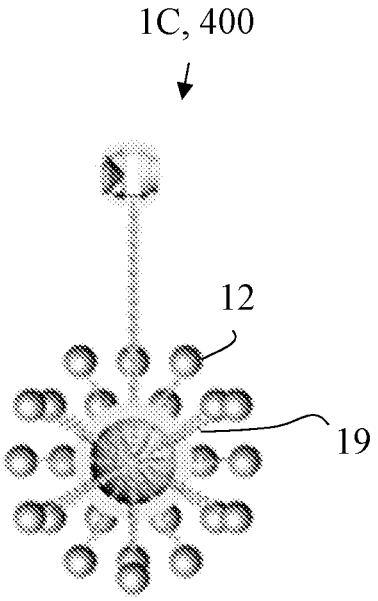
FIG. 16 is a partial cutaway view of an earring 1C substantially as provided in FIG. 14, in an expanded ornamentation 400.
Figure 17:
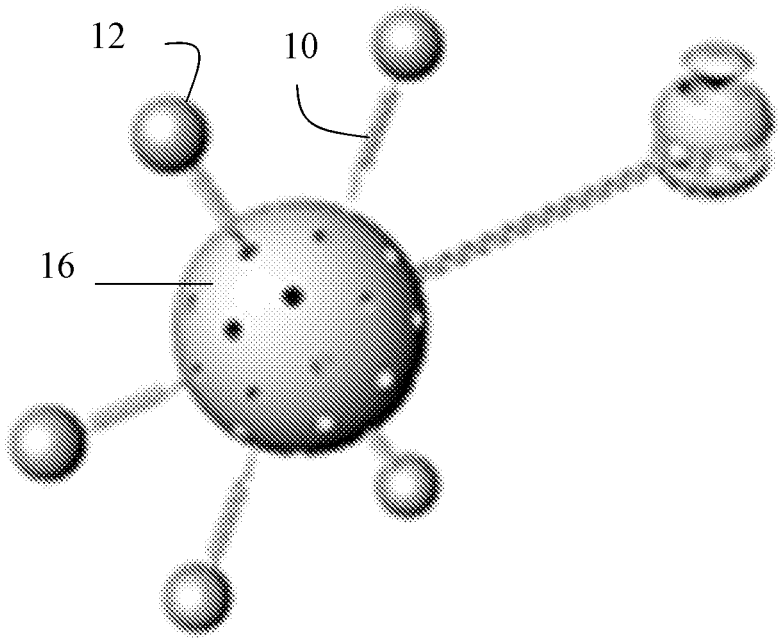
FIG. 17 is a partially exploded view of an earring 1C substantially as provided in FIG. 14.

As shown more clearly in FIGS. 14-16, strands 10 can also trained from a two way shape memory metal to form a coil 19, where the coil is contracted in one position FIG. 14:300; FIG. 15:300 and expanded in a second position FIG. 14:400; FIG. 16:400.

Figure 18:
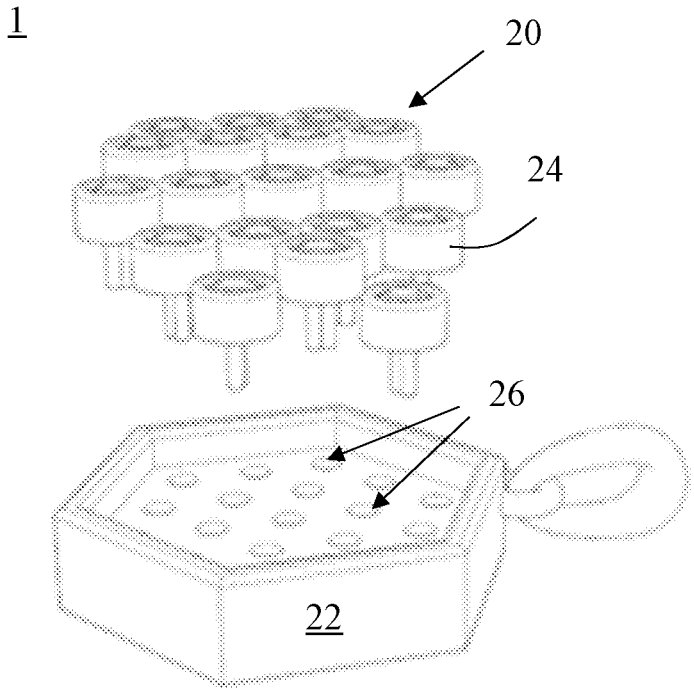
FIG. 18 is an exploded view of jewelry 1 with interchangeable gems 20 with a fenestrated base 22.
Figure 19:
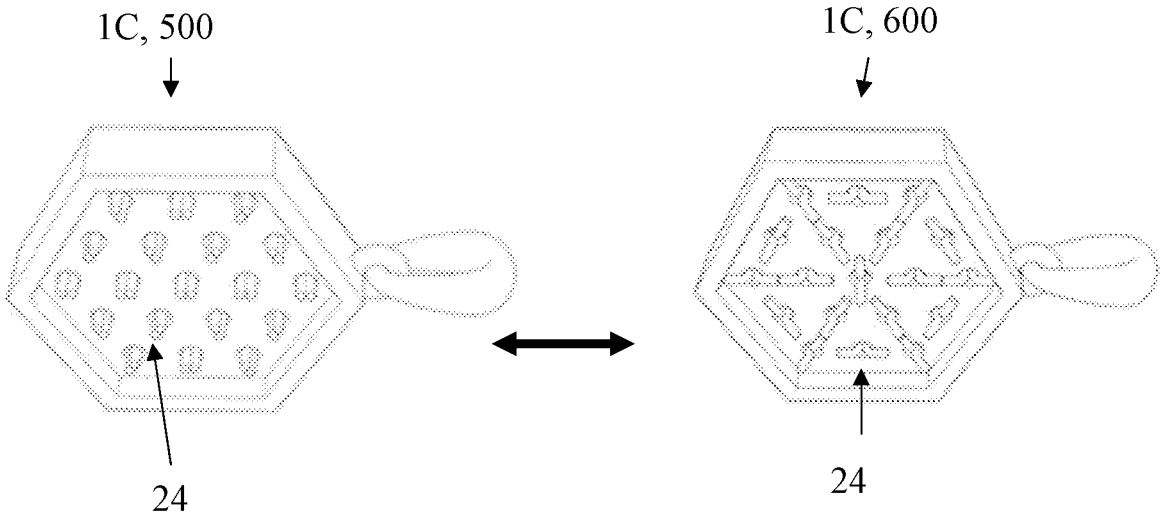
FIG. 19 depicts a pendant 1C that reversibly transitions between a releasing configuration 500 and a locked configuration 600 in response to changes in temperature.
Figure 20:
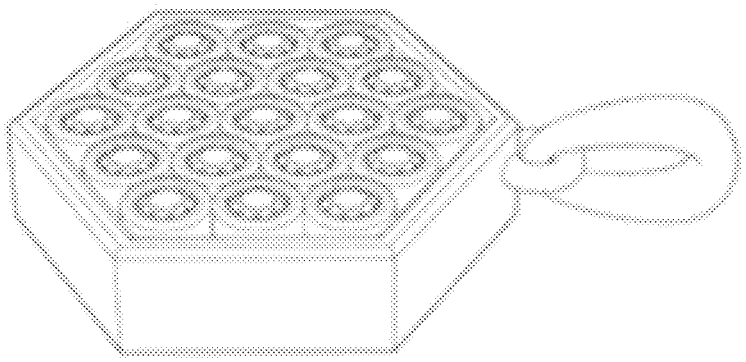
FIG. 20 depicts a top isometric view of the pendent 1C of FIG. 19 in a locked configuration 500.

Now, with reference to FIGS. 18-20, an article of jewelry 1 having precious or semi-precious gems 20 that interchangeably connect to a fenestrated base 22 is also provided. Each gem is held by a bezel 24. The improvement provides that the bezel 24 is formed from a shape memory alloy trained to reversibly transition between two set positions in response to two different temperatures. One set position locks 600 the bezel 24 through the fenestrations 26 of the base 22 and another set position releases 500 the bezel 24 from the fenestrations 26 of the base 22. As such, releasing 500 the gems 20 from the base 22 involves applying a first temperature and locking 600 the gems 20 to the base 22 involves applying a second temperature. The shape memory alloy can be trained using the guidance above.

In preferred embodiments, the bezel 24 is generally characterized as being an elongated strand in the first state and in the second state the bezel has outwardly flanged strand. Change of temperature to initiate change between first and second states can be by way of a heating element and/or a cooling element. Most preferably, the shape memory alloy is nitinol, having an austenite phase and a martensite phase substantially as described above.

The invention described above may be embodied in other specific forms without departing from the spirit or essential characteristics thereof. The specific embodiments previously described are therefor to be considered as illustrative of, and not limiting, the scope of the invention.

What is claimed is:

1. An article of jewelry that reversibly transitions between two different ornamentations, the article of jewelry comprising a plurality of solid strands, each strand formed from a two-way shape memory alloy trained to reversibly transition between two set positions in response to two different temperatures, wherein one of the two set positions differs between two different strands, wherein the strands are anchored at a proximal end and connected to distal elements at a distal end, thereby directing shape memory movement of the distal elements in response to the two different temperatures.

2. The article of jewelry according to claim 1, wherein the shape memory alloy is a nickel titanium alloy, in particular nitinol.

3. The article of jewelry according to claim 1, wherein the plurality of strands are arranged in layers so that strands having a set position comprising a larger arc measure are positioned outside of strands comprising a set position comprising a smaller arc measure.

4. The article of jewelry according to claim 1, wherein the two set positions differ between the two different strands.

5. The article of jewelry according to claim 1, wherein at least some of the plurality of strands transition between arcs of different measure.

6. The article of jewelry according to claim 1, wherein at least some of the plurality of strands transition between linear and non-linear set positions.

7. The article of jewelry according to claim 1, wherein, in response to the two different temperatures, a first set of distal elements close against one another in a first set position and open away from one another in a second set position.

8. The article of jewelry according to claim 7, wherein, in response to the two different temperatures, a first set of distal elements close against one another in a first set position to hide an inner ornamentation and open away from one another in a second set position to display the inner ornamentation.

9. The article of jewelry according to claim 1, wherein the article of jewelry is selected from the group consisting of a ring, an earring, and a pendant.

10. An article of jewelry that reversibly transitions between two different ornamentations, the article of jewelry comprising a plurality of solid strands, each strand formed from a two-way shape memory alloy trained to reversibly transition between two set positions in response to two different temperatures, wherein a first set of distal elements comprise leaflets that close against one another in a first set position and open away from another in a second set position, wherein the strands are anchored at a proximal end and connected to distal elements at a distal end, thereby directing shape memory movement of the distal elements in response to the two different temperatures.

11. The article of jewelry according to claim 10, wherein the leaflets close against one another to hide an inner ornamentation in a first set position and open away from one another to reveal the inner ornamentation in a second set position.

12. The article of jewelry according to claim 11, wherein a second set of distal elements comprise precious or semi-precious gems maintained outside of the leaflets.

13. An article of jewelry that reversibly transitions between two different ornamentations, the article of jewelry comprising a plurality of solid strands, each strand formed from a two-way shape memory alloy trained to reversibly transition between two set positions in response to two different temperatures, wherein the strands are anchored at a proximal end and connected to distal elements comprising precious or semi-precious gems at a distal end, thereby directing shape memory movement of the distal elements in response to the two different temperatures.

14. The article of jewelry according to claim 13, wherein the gems are independently selected from the group consisting of an agate, an alexandrite, an amber, an ametrine, an amethyst, an aquamarine, an apatile, a beryl, a bloodstone, a chrysoberyl or cat-eye, a citrine, a corundum, a chalcedony, a chysocolla, a coral, a diamond, an emerald, a green beryl, a garnet, a quartz, a lolite, a jadeite, a kupzite, a lapis lazuli, a moonstone, a malachite, a moamite, an onyx, an opal, a pearl, a peridot, a red corundum, a ruby, a sardonyx, a sapphire, a spessartime, a sphene, a spinel, a star ruby and sapphire, a sunstone, a tanzanite a tiger eye, a tourmaline, a topaz, a turquoise, a tsavorite, and a zircon.

15. An article of jewelry comprising precious or semi-precious gems that interchangeably connect to a fenestrated base, each gem held by a bezel, characterized in that the bezel comprises a shape memory alloy trained to reversibly transition between two set positions in response to two different temperatures, wherein a first set position locks the bezel through the fenestrations of the base and a second set position releases the bezel from the fenestrations of the base.

16. An article of jewelry that reversibly transitions between two different ornamentations, the article of jewelry comprising a plurality of solid strands, each strand formed from a two-way shape memory alloy trained to reversibly transition between two set positions in response to two different temperatures, wherein at least some of the plurality of strands comprise a tighter coil in one set position compared to another set position, wherein the strands are anchored at a proximal end and connected to distal elements at a distal end, thereby directing shape memory movement of the distal elements in response to the two different temperatures.

* * * * *